United States Patent [19]

Nishikawa

[11] Patent Number: 4,548,401

[45] Date of Patent: Oct. 22, 1985

[54] SHEET FEED APPARATUS

[75] Inventor: Masaji Nishikawa, Hachioji, Japan

[73] Assignee: Olympus Optical Company Ltd., Tokyo, Japan

[21] Appl. No.: 507,911

[22] Filed: Jun. 27, 1983

Related U.S. Application Data

[63] Continuation of Ser. No. 950,310, Oct. 10, 1978, abandoned.

[30] Foreign Application Priority Data

Oct. 13, 1977 [JP] Japan ..... 52-121882

[51] Int. Cl.[4] ..... B65H 7/02

[52] U.S. Cl. ..... 271/265; 271/227; 271/242; 271/261

[58] Field of Search ..... 271/227, 265, 258, 259, 271/261, 257, 242

[56] References Cited

U.S. PATENT DOCUMENTS

| | | | |
|---|---|---|---|
| 2,811,353 | 10/1957 | Alden | 271/258 |
| 2,933,557 | 4/1960 | Strickholm | 271/258 X |
| 3,095,192 | 6/1963 | Simjian | 271/265 X |
| 3,335,662 | 8/1967 | Ritzerfeld | 271/265 X |
| 4,052,054 | 10/1977 | Cardwell | 271/227 |
| 4,072,306 | 2/1978 | Idstein | 271/265 X |
| 4,132,401 | 1/1979 | Gauronski | 271/265 X |

*Primary Examiner*—Richard A. Schacher

*Attorney, Agent, or Firm*—Fleit, Jacobson, Cohn & Price

[57] ABSTRACT

An apparatus for feeding sheets such as sheet like documents to be duplicated by an electrophotographic apparatus, said sheet like documents being successively supplied on a document table of the electrophotographic apparatus one by one manual operation of a user, comprises feeding means such as feeding rollers or a feeding belt mechanism, the feeding means being remained inoperative immediately after the supply of sheet, and means for initiating the feeding operation of said feeding means after a margin of time during which the user can correct the position and posture of the sheet.

2 Claims, 10 Drawing Figures

SHEET FEED APPARATUS

This application is a continuation of application Ser. No. 950,310, filed Oct. 10, 1978, now abandoned.

BACKGROUND OF THE INVENTION

The present invention relates to an apparatus for feeding successively sheet like members such as sheet like documents, sheet like photosensitive papers, sheet like image receiving papers, etc. which are manually supplied to the sheet feed apparatus one by one by a user.

For instance, in a duplicating apparatus there have been developed a sheet feed apparatus comprising rollers which feed a sheet like document or a recording paper which is manually brought by a user at a position which is an upstream side of the rollers. A further known sheet feed apparatus comprises a belt conveyer device installed in a document cover, said belt conveyer device feeds the sheet like document to a given exposing position at which the stationary document is exposed by a moving optical system or a one-shot exposing optical system. In a Japanese Patent Application Publication No. 2,579/75 there is also described a sheet feed apparatus which comprises a first pair of rollers made of soft and resilient material and arranged at an entrance of the apparatus and a second pair of rollers arranged at a downstream relative to the first pair of rollers. The first pair of rollers is made rotatable in a forward feed direction until a front edge of the sheet is grasped by the second pair of rollers and after that the first pair of rollers is driven in an opposite direction so as to stretch folded or shrunk sheets. Further in a Japanese Patent Application Laid-Open Publication No. 8,247/73 there is disclosed a sheet feed apparatus comprising at least two pairs of feed rollers arranged integrally with a document table. In this apparatus the document is exposed while it is fed between the pairs of feed rollers.

In the above mentioned known sheet feed apparatuses since the member for feeding the sheets is made always operative or is made operative immediately after a detection of the supply of the sheet, the sheet might be fed while it is not in a correct position and thus there is a fear that the sheets might be folded or shrunk. Therefore the user must supply the sheets very carefully. Such a document supply operation is quite combersome and the user is subjected to a mental stress.

In order to avoid the above mentioned drawbacks of the known sheet feed apparatuses there has been devised another known apparatus which comprises a first mechanism for feeding a manually supplied document into a given position and a second mechanism for further feeding the document from the given position into a duplicating position after ascertaining the document being in a correct position at the given position. The first feeding mechanism comprises rollers which feed the document to a given corner after detecting photoelectrically the document and the second mechanism is made operative upon a detection signal which is produced when the edge of the document is brought into the given corner. This sheet feed mechanism can feed the manually supplied sheet like document with correct position. However the apparatus is very complicated and is large in size and thus is quite expensive. Further if the document is thin and transparent or translucent, the operation might be unstable and an erroneous operation might occur.

SUMMARY OF THE INVENTION

The present invention has for its object to provide a sheet feed apparatus which can obviate the above mentioned drawbacks of the known apparatuses and a user can supply successive sheets with a margin of time during which the user can correct a position of document relative to the apparatus.

It is another object of the invention to provide a sheet feed apparatus which can feed stably the documents by a manual operation irrespective of kinds of sheets.

It is another object of the invention to provide a sheet feed apparatus in which a succeeding sheet can be manually supplied while a previous sheet is fed, so that a user can have sufficient time to correct the position of the sheets.

It is still another object of the invention to provide a sheet feed apparatus which initiates the feeding of sheets after detecting the sheets being in a correct position with a correct posture.

According to the invention an apparatus for feeding sheets which are successively supplied one by one by a manual operation of a user comprises means for feeding the sheets; and means for initiating the operation of said feeding means after a margin of time during which the user can set the sheets with a correct posture at a correct position.

A sheet feed apparatus according to the invention comprises means for feeding the sheets, said means being made inoperative immediately after the supply of the sheets;

means for detecting the supply of the sheets to produce a sheet detection signal;

means for delaying the sheet detection signal from the sheet detecting means; and means responsive to said delayed sheet detection signal to initiate the operation of the feeding means.

According to a further aspect of the invention a sheet feed apparatus comprises means for feeding a sheet, said feeding means being made inoperative normally;

means for producing a feed start signal upon a manual operation of a user after the position and posture of the sheet have been corrected; and means responsive to said feed start signal to initiate the operation of said feeding means.

According to still further aspect of the invention a sheet feed apparatus comprises means for feeding the sheets;

means arranged at an upstream position relative to the feeding means viewing in a feeding direction for restraining the manually supplied sheets; and means for disabling the sheet restraining function of said restraining means until a front edge of a preceding sheet is fed into the feeding means and for making operative said restraining means without disturbing the feeding operation of the previous sheet.

A sheet feed apparatus according to still another aspect of the invention comprises means for feeding sheets which are manually supplied one by one by a user;

a table like member on which the sheets to be fed are placed;

a plurality of sheet detecting members arranged on and/or near said table like member each for detecting the sheet to produce a sheet detection signal; and means responsive to all outputs from said plurality of detecting members for initiating the operation of said feeding means.

DESCRIPTION OF THE PREFERRED EMBODIMENT

Figure 1:
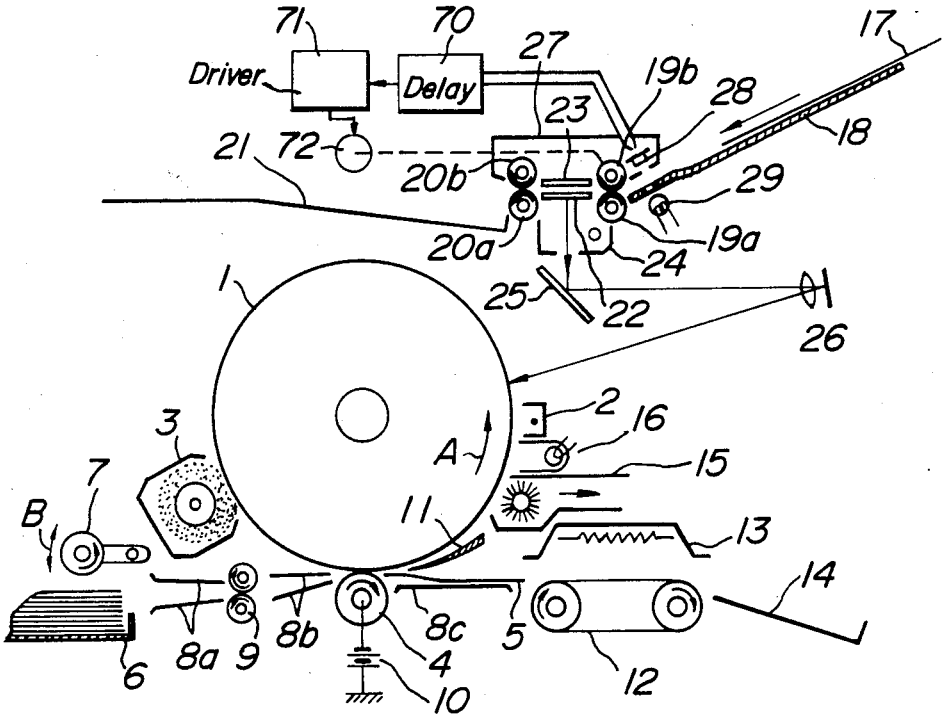
FIG. 1 is a schematic view showing an electrophotographic apparatus which comprises a sheet like document feed apparatus according to the invention.

FIG. 1 is a schematic diagram showing an embodiment of a sheet feed apparatus according to the invention installed in an electrophotographic apparatus for feeding sheet like documents. The electrophotographic apparatus comprises a photoconductive drum 1 journaled rotatably in a direction indicated by an arrow A and a corona charger 2 for electrifying the drum uniformly. The apparatus further comprises optical means for projecting a light image of a document 17 to be duplicated onto the uniformly charged drum 1 to form thereon an electrostatic charge latent image corresponding to the image of the document. The latent image is converted into a visible image of toners by means of a development device 3. The toner image thus formed on the drum 1 is transferred onto an image receiving paper 5 at a transfer roller 4. Record papers are stuck in a paper cassette 6 and are successively fed one by one by means of a pick-up roller 7 which swings in synchronism with the rotation of the drum 1 as shown by an arrow B. The picked up paper is further fed between the drum 1 and the transfer roller 4 through a paper guide 8*a*, a pair of feeding rollers 9 and a paper guide 8*b*. The transfer roller 4 serves to press the paper 5 against the drum 1 and to form a transfer electric field with the aid of a transfer bias voltage supply source 10 connected across the drum 1 and the roller 4. The paper 5 on which the toner image has been transferred is torn out of the drum 1 by a tearing craw 11 and is fed through a paper guide 8*c* to an oven heater 13 by means of a belt 12. At the heater 13 the toner is heated and fused to the paper 5. In this manner the paper 5 having the visible toner image applied thereto is discharged on a tray 14 as a final duplicated copy. Residual toner particles on the drum 1 are removed by a cleaning device 15 and then the electrostatic charge image on the drum 1 is erased by an illumination of an erasing lamp 16. In this manner a preparation for a next duplicating process has been completed. If a plurality of duplicated copies are to be formed with the aid of the single and same charge latent image once formed on the drum 1, the development and transfer steps are successively repeated while the cleaning device 15 and the erasing lamp 16 being maintained inoperative.

In the electrophotographic apparatus shown in FIG. 1 the projection of the document image is effected while the document 17 is fed along a predetermined passage. To this end the document 17 is placed manually on a document table 18 and is fed by means of two pairs of document feed rollers 19*a*, 19*b* and 20*a*, 20*b*. The document is discharged on a document tray 21. Between the rollers 19*a* and 20*a*, and 19*b* and 20*b* there are arranged document guide plates 22 and 23, respectively. While the document 17 is fed between these plates 22 and 23 the document is illuminated by an illumination device 24. Light reflected from the document is projected onto the drum 1 by means of a mirror 25 and a projection lens 26. The lower document guide plate 22 is made of transparent material such as glass and the upper document guide plate 23 is made of white material or a reflecting plate having applied a white paint thereon. Above the document feeding rollers is provided an opaque cover 27 which prevents an entrance of undesired external light into the apparatus.

In known document feed mechanism of the type shown in FIG. 1 the document feed rollers 19*a*; 19*b* and 20*a*; 20*b* are made normally rotated or is initiated to rotate upon a detection of a front edge of the document by means of a document detection switch which comprises for example a photoelectric converter 28 and a lamp 29 arranged oppositely in front of the rollers 19*a* and 19*b*. In either case the document 17 is fed by the rollers 19*a*, 19*b* as soon as it is manually placed on the document table 18. Therefore in order to feed the document with a correct posture at a correct position substantial care has to be paid. Such a feeding mechanism is also known that the feeding of the document is temporarily stopped after the front edge of the document is clamped between the rollers 19*a* and 19*b*. However even in such a mechanism the above mentioned drawback is still manifested, because the position and posture of the document are determined at such a time that the front edge of the document is just clamped between the rollers. Moreover in the known document feed apparatus a succeeding document can be supplied only after a rear edge of the preceding document has passed through the feed rollers 19*a* and 19*b* and thus in case of effecting in succession a duplicating operation for successive documents a user could not have a sufficient margin of time for correctly supplying the documents on the document table 18.

According to the invention in order to avoid the above mentioned disadvantages of the known document feed apparatus the document which is manually supplied is not fed instantaneously, but is fed after a margin of time during which the position and posture of document can be manually corrected. In order to restrain the instantaneous feeding of the document the feeding rollers may be made inoperative for a predetermined time period or a restraining member may be provided for temporarily inhibiting the document feed. The above function for feeding the documents after a margin of time can be realized by any one of the following three measures:

(1) The manual supply of the document is automatically detected by means of a microswitch, a photoelectric switch and the like and the document feed mechanism is actuated after a predetermined time period has been elapsed from the detection of the document.

(2) After the document is manually supplied the feeding mechanism is actuated upon a manual operation of a start switch.

(3) During the feeding of a previous document a manual supply of a succeeding document is allowed.

The first measure (1) can be attained by various methods. For instance the edge detection signal can be used to actuate an electric or electric-mechanical means such as a timer. Alternatively the edge detection signal may be used to rotate or move a cum or a lever which actuates the document feed mechanism after a predetermined time interval.

In the embodiment shown in FIG. 1 a document detection signal from the photoelectric converter 28 is supplied to a delay circuit 70 having a predetermined delay time. After the delay time has elapsed the delay circuit 70 supplies a signal to a motor driving circuit 71 to make the latter circuit operative. Then the circuit 71 energizes a motor 72 which drives at least the feed rollers 19*a* and 19*b*. In this manner the user can have a sufficient margin of time during which the user can set the document on the table 18 with a correct posture at a correct position.

Figure 2:
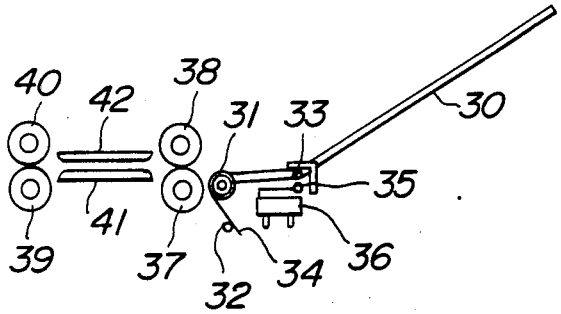
FIG. 2 is a schematic side elevation illustrating an embodiment of a sheet feed apparatus according to the invention.

The second measure (2) can be realized by providing a manually operated start switch on an operation panel of the electrophotographic apparatus or on the document table. When the apparatus comprises a print start switch for duplicating a thick document such as a book, this switch may be utilized as the start switch for actuating the document feed mechanism. The start switch may be provided at any position on the apparatus. It is preferable to arrange the start switch on or near the table and actuate the switch by moving slightly the document table on which the document is supplied manually. FIG. 2 is a schematic diagram showing such an embodiment of the mechanism for actuating such a start switch.

In FIG. 2 a document table 30 is journaled about a shaft 31. The table 30 is biased to rotate in the anticlockwise direction by means of a coiled spring 34 one end of which is engaged with a pin 32 secured to a stationary part of the apparatus and the other end is engaged with a pin 33 secured to the table 30. There is further provided a stopper 35 which engages with the pin 33 so as to limit the rotation of the table in the anti-clockwise direction. Under the table is arranged a microswitch 36 which is actuated by a lower surface of the table. When the document is placed correctly on the table 30, a user decreases the free end of the table slightly against the force of the spring 34 to actuate the microswitch 36 which then produces a start signal to a motor driving circuit which drives feed rollers 37, 38, 39 and 40. In this manner the document is fed with the correct position and posture through a pair of document guide plates 41 and 42. During this feeding operation the document is optically scanned by an optical system. In this document feed apparatus the document is never fed unless the document table 30 is depressed and thus there is enough time for the user to correct the position and posture of the document on the table 30. In an alternative embodiment the document table 30 may be formed by resilient material and the microswitch may be actuated by bending the table against its elastic force. In such a case the spring 34 may be omitted.

The third measure (3) could never be realized by the known sheet feed apparatuses, because the succeeding sheet is always fed simultaneously with the preceding sheet. According to the invention this measure (3) can be realized by menas of a relatively simple construction.

Figure 3:
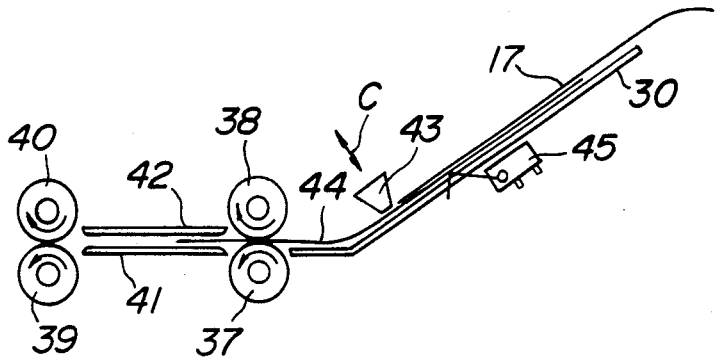
FIGS. 3, 4 and 5 are schematic side elevations showing several embodiments of the sheet feed apparatus according to the invention.

FIG. 3 is a schematic side view showing an embodiment of the sheet like document feed apparatus according to the invention. In this embodiment a document restraining member 43 is arranged on the upstream side relative to feed rollers 37 and 38 viewed in the direction of document feed. The restraining member 43 is made movable in a direction shown by an arrow C above a document table 30. The movement of this member 43 is controlled by document detecting means, in this embodiment a microswitch 45 which has an operation arm projecting from a lower surface to an upper surface of the table 30. When the microswitch 45 detects a document 17 which is manually placed on the table 30, the stopper 43 is moved upward instantaneously or after a certain time period and the member 45 is remained in this position at least as long as the front edge of document is clamped between the feed rollers 37 and 38. Then the member 45 returns into its initial position. Now it is possible to supply a next document on the table 30 at any time during the transportation of the previous document and thus there is a enough time to correct the position and posture of this next document on the table 30. After the preceding document has been completely fed by means of the rollers 37, 38 and 39, 40, the duplicating operation for the preceding document has been finished, and a preparation for the succeeding document has been completed, a signal is produced and the document restraining member 45 is actuated again by this signal to be apart from the document table. Now the succeeding document on the table can be fed by the rollers 37 and 38.

The document restraining member 43 may be made of soft material such as rubber, felt, foamed plastics material, for example sponge or hard material such as plastics and metal. A cross section of the member may have any configuration such as rectangle, triangle, circle, semi-circle, and the like. The restraining member 43 may be extended over a whole width of the document table or a part thereof. The restraining member 43 should be urged against the document table in such a manner that the preceding document can be smoothly fed without causing shrinkage, breaking and stain or soil and at the same time the succeeding document can be positively prevented from being fed by the feeding rollers 37 and 38. Such a construction can be realized by utilizing a weight of the restraining member 43 or a suitable spring member. Alternatively the document restraining member is made of resilient material and is resiliently pressed against the table 30 by an external force. In this case a stopper may be arranged for limiting the movement of the member to a given level. Further instead of the inclined document table use may be made of horizontally arranged document table comprising a feeding roller mecahnism or a feeding belt mechanism.

Figure 4:
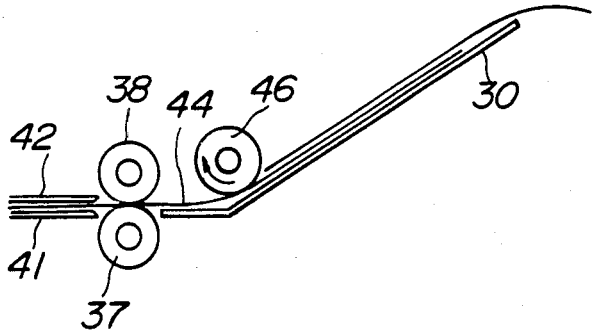

FIG. 4 is a side view showing schematically another embodiment of the document feed apparatus according to the invention. In this embodiment as the document restraining member use is made of a restraining roller 46. When the document restraining roller 46 is made stationary or rotated in a direction opposite to a document feed direction, the document is manually placed on a document table 30. Upon a document detection signal or a document feed order signal the roller 46 is driven instantaneously or after a certain time period in the feed direction to feed the document. The roller 46 is made rotated at least until a front edge of document is clamped between a pair of feed rollers 37 and 38. Then the roller 46 is stopped or rotated in the opposite direction. From this instance manual supply of a next document is allowed. This embodiment has an advantage over the previous embodiment shown in FIG. 3 in that the document can be positively clamped between the rollers 37 and 38 by means of the roller 46 rotating in the feed direction.

Figure 5:
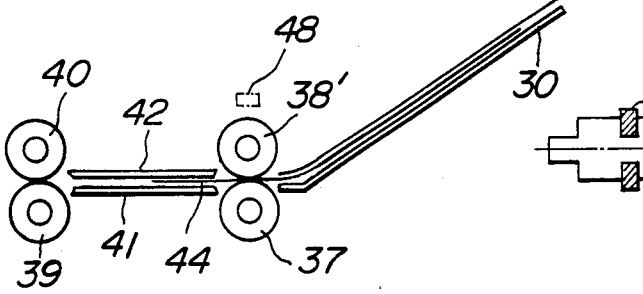

FIG. 5 illustrates still another document feed apparatus according to the invention. In this embodiment one of the document feed rollers 38' serves also as a document restraining roller. This roller 38' may be made of rubber having relatively weak resilience. The roller 38' may be driven in the manner as explained above with reference to FIG. 4.

Figure 6:
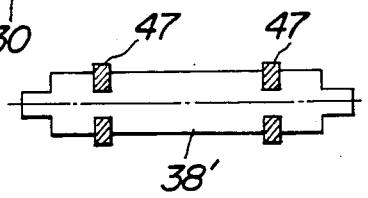
FIG. 6 is a cross section depicting an embodiment of a sheet restraining roller of FIG. 5.

When the document feed might be disturbed by the roller 38' which is stationary or oppositely rotated, the roller 38' may be formed as shown in FIG. 6. That is rings 47 of resilient material such as foamed material, for example, sponge having a very large deformability are arranged around the rollers 38'. When the front edge of document is clamped between the feed rollers 39 and 40, the roller 38' is made apart from the roller 37 and is made stopped or rotated in the opposite direction. In this case even at the raised position of the roller 38' the rings 47 are made in contact with the roller 37 and thus the previous document can be positively fed and also the succeeding document can be effectively restrained on the table 30. In the embodiments illustrated in FIGS. 4 and 5 the restraining rollers 46 and 38' may be formed by similar material for forming the restraining member 43 illustrated in FIG. 3. In the embodiments shown in FIGS. 4 and 5 the restraining rollers 46 and 38' can be driven in the backward and forward directions by changing an engagement of a gear mechanism, a rotational direction of a reversible motor, a power transmission path with a clutch, etc. Further a control mechanism can be simplified by constructing the roller 38' in such a manner that it is forced to rotate by means of the rotation of the roller 37 and is made stationary by a friction of its bearing mechanism while it is apart from the roller 37. In this case a stationary member 48 (see FIG. 5) may be arranged above the roller 38' at such a position that the raised roller 38' is made in contact with the member 48.

Now a control device for releasing the restraint of sheets to initiate the document feed in the embodiments shown in FIGS. 3, 4 and 5 will be explained. In such a control device it is necessary to produce a sheet or document feed signal after the sheet has been correctly placed on the document table. The document feed signal can be produced by the following means:

(1) The document feed signal is generated when the document is detected by a microswitch, a photoelectric detector and the like arranged on the document table.

(2) A copy switch provided on an operation panel of a casing of the electrophotographic apparatus is actuated to produce the document feed signal.

(3) A microswitch installed in or near the document table is actuated by moving the document table as shown in FIG. 2.

According to the invention two documents can be existent simultaneously on the document table 30 and the succeeding document can be manually placed on the table while the preceding document is fed. To this end it is necessary to store the signal which is given at the supply of the succeeding document and this stored signal is used to release the restraint of the document feed.

Figure 7:
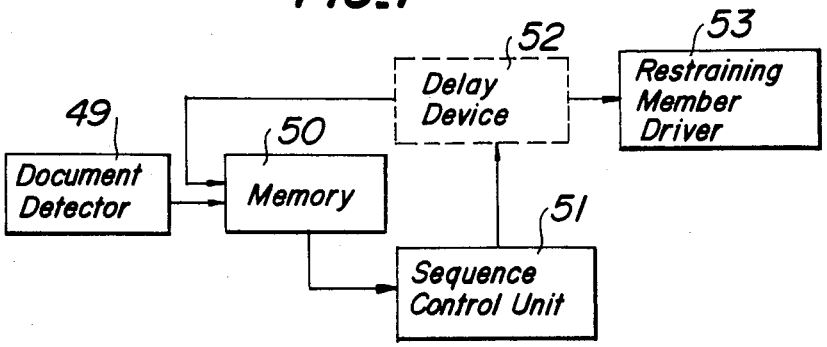
FIGS. 7 and 8 are block diagrams showing two embodiments of a control device provided in the sheet feed apparatus according to the invention.

FIG. 7 is a block diagram illustrating an embodiment of the control device according to the invention. In FIG. 7 a document detecting device 49 produces a document detection signal after the document is placed on the document table. This device may be manually operated by a user as illustrated in FIG. 2. The document detection signal is supplied to a memory 50 which actuates a sequence control unit 51. The unit 51 produces a signal at a time instance which is slightly prior to that at which the document feed is allowed. This signal is supplied to a document restraining member driver 53 through a delay device 52. At the same time the delay device 52 produces a signal for resetting the memory 50. If the document detection device 49 is a type of producing the document detection signal by the microswitch or the photoelectric switch mentioned in the first measure (1), this signal is continuously generated as long as the document is extent on the document table. Thus even if the memory 50 receives the reset signal from the delay device 52 it produces the signal to the sequence control unit 51. Therefore the succeeding document is fed by the signal supplied from the sequence control unit 51 at such a time instance that the preparation for the next duplicating operation has been finished.

Further if the document detection device 49 produces the signal when it is actuated by a user, the signal corresponding to the supply of the succeeding document is stored in the memory 50 which has been released by the reset signal and a start signal is supplied to the sequence control unit 51. The succeeding document is fed at such a timing that the duplicating operation for this document is prepared after the duplication for the preceding document has been completed.

Figure 8:
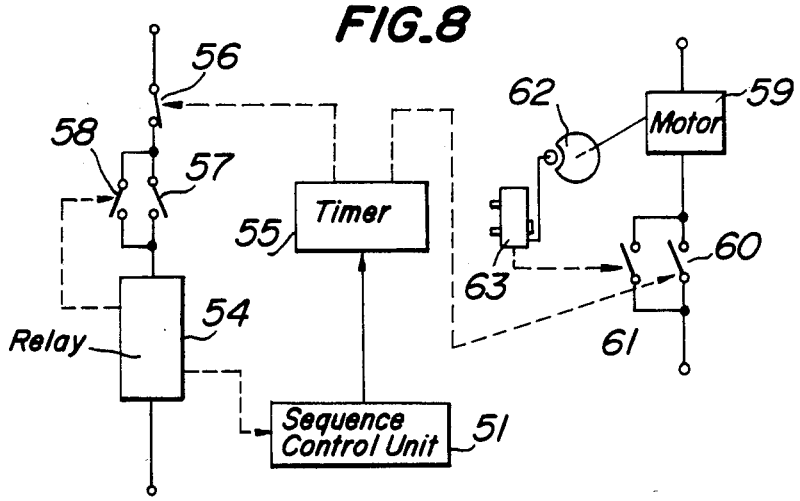

FIG. 8 is an embodiment of the control device shown in FIG. 7. In this embodiment the memory 50 is constructed by a relay 54 and the delay device 52 is formed by a timer 55. Moreover a document restraining member 53 is constituted by a restraining roller such as the rollers 46 and 38' illustrated in FIGS. 4 and 5, respectively. In series with the relay 54 are connected a reset switch 56 which is made closed instantaneously by the reset signal from the timer 55 and a document detection switch 57 of a normally open type. A self-holding contact 58 of the relay 54 is connected across the switch 57. The series circuit of the relay 54 and contacts 56, 57 is connected to a supply voltage source (not shown). The document detection switch 57 is made automatically or manually closed after the document is supplied on the document table. When the relay 54 is energized, it actuates the sequence control unit 51 by means of a switch (not shown). The document restraining roller (46, 38') is driven by a motor 59 which is connected to a suitable supply voltage source (not shown) through a start switch 60 which is made instantaneously closed by the signal from the timer 55. Across the switch 60 is connected a self-holding contact 61 which is a normally open switch driven by a microswitch 63 which is operated by a cam plate 62 secured to a shaft of the document restraining roller.

When the document detection switch 57 is made closed after the document is placed on the table, the relay 54 is energized so as to close the self-hold contact 58. Then the sequence control unit 51 is initiated. The relay 54 is self-holded even when the switch 57 is made opened. Slightly before the allowance of the document feed the control unit 51 produces the signal to the timer 55. When a given time has been elapsed, the timer 55 produces the signals one of which serves to open the reset switch 56 to deenergize the relay 54 and the other serves to close the start switch 60 to energize the motor 59. When the motor 59 rotates, the self-holding contact 61 is made closed by means of the cam plate 62 and microswitch 63. The motor 59 is remained energized until the document is clamped between the feed rollers 37, 38. During this interval the document restraining roller rotates over, for example, one revolution. Then the cam plate 62 actuates the microswitch 63 to open the self-holding contact 61. During the feeding of the document when the next document is supplied, the document detection switch 57 is made closed to energize the relay 54. This situation continues until the timer 55 has been completed its function. After that the above explained operation is repeated. In the circuit arrangement shown in FIG. 7 successively supplied documents are fed in the manner mentioned above and when all documents to be duplicated have been fed, the relay 54 is remained deenergized and the electrophotographic apparatus stops its operation.

When the document detection signal is generated by the existence of the document with the aid of the microswitch as shown in FIG. 3, this signal is continuously produced as long as the document is on the table and thus the relay 54 and its self-holding circuit corresponding to the memory 50 (FIG. 7) may be dispensed with. Further when the restraint of the document is released by moving the restraining member (43, 46, 38') away from the document feeding path, the restraining member may be driven by a solenoid energizied by a signal from the timer 55. Then the self-holding contact 61 may be driven by the movement of the restraining member.

In the embodiments illustrated in FIGS. 4 and 5 in order to rotate the document restraining rollers 46 and 38' in the forward and backward directions a suitable clutch may be inserted between a shaft of the motor 59 and the rollers and this clutch is controlled by a signal derived from the timer 55. Moreover in the embodiment shown in FIG. 5 the document restraining roller 38' may be biased by a spring to move away from the roller 37 and a solenoid may be connected in parallel with the motor 59. When the motor 59 is energized, the solenoid is energized to bring the roller 38' in contact with the document feed roller 37.

The control circuit shown in FIG. 8 may be advantageously applied to the document feed apparatus illustrated in FIG. 2 in which the document detection switch 57 is closed by operating the document table 30. In this case the construction is very simple and the operation is quite positive and convenient.

Figure 9:
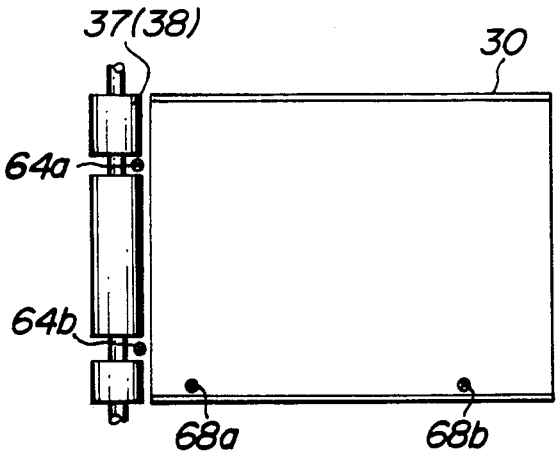
FIG. 9 is a plan view showing another embodiment of the sheet feed apparatus according to the invention.

FIG. 9 is a plan view showing another embodiment of the sheet like document feed apparatus according to the invention. In this embodiment the document is fed after its correct position and posture have been detected. To this end more than two photoelectric detectors are provided on the document table 30 and near the document feed rollers 37, 38 and when all detectors detect the document the feed rollers 37 and 38 are driven. Two detectors **64*a* and 64*b* are arranged in spaces formed in the rollers 37 and 38**.

Figure 10:
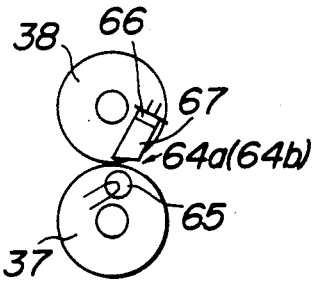
FIG. 10 is a schematic view illustrating an embodiment of a sheet detecting device for use in the sheet feed apparatus according to the invention.

FIG. 10 is a side view showing an arrangement of a lamp 65 and a light receiving cell 66 of the detector **64*a* (64*b*). These elements are provided on respective side of the document feeding path. In front of the cell 66 is provided an opaque cylinder 67 so that the cell can receive only the light from the lamp 65. On the document table 30 there are arranged two detectors 68*a* and 68*b* along one side of the document table 30. In a modified embodiment only two detectors 64*a* and 68*b*** may be arranged at two points on a diagonal line of the document. In this case the accuracy is increased by increasing the length between the two detectors.

In the sheet feed apparatus shown in FIG. 9 when a plurality of documents are to be successively fed, the succeeding document can be fed by a signal which is produced when the duplicating operation for this document has been prepared. Therefore in this case the control device shown in FIGS. 7 and 8 may be utilized. Moreover in this embodiment since the document feed rollers are not actuated until all the detectors detect the document, the document can be alway fed with a correct posture and position.

If there is enough time difference between the completion of the preceding document feed and the initiation of the succeeding document feed, there is no trouble even if there is not provided an extra time margin from the supply of the succeeding document to its feeding operation. However in usual high speed duplicating apparatus said time difference is small. In such a case there may be established a time delay from the document detection to the document feed by means of a timer and this delay time is compared with a time margin which is determined by the control sequence of the apparatus to select longer one. Moreover the delay time may be manually adjusted from the external so as to match the delay time to particular users.

According to the present invention the sheet which is manually supplied is not fed instantaneously, but fed after a certain margin of time during which the user can correct the position and posture of sheet relative to the sheet feed apparatus. Therefore the sheet can be positively fed with the correct position and posture and further its shrinkage and folding can be effectively avoided.

The present invention is not limited to the embodiments explained above, but many modifications can be concieved within the scope of the invention. In the above embodiment the sheet feeding means are constructed by the two pairs of feed rollers, but it may be formed by a feeding belt mechanism. In this case use may be made of a vacuum suction device in combination with the belt transporting mechanism. Further a document guide plate may be provided on the document table in a fixed or movable manner so as to align the document. Moreover the sheet feed apparatus according to the invention may be applied to various types of duplicating apparatuses using as a photosensitive member a zinc oxide paper, a silver compound film, a photographic paper, a diazo photosensitive member, a thermosensitive record paper, a microfilm photographic apparatus, a facsimile apparatus, and the like. Further the present sheet feed apparatus may be used to feed record papers in the duplicating apparatuses or print papers in printing apparatuses. If the sheet apparatus according to the invention is applied to a document feed mechanism in an electrophotographic apparatus in which a plurality of copies are formed on the basis of the same and single electrostatic charge latent image once formed on a photosensitive member, the advantages of both mechanisms are combined multiplicatively to provide a very convenient duplicating apparatus.

What is claimed is:

1. An apparatus for feeding single sheets which are successively supplied one by one by manual operation of a user, said apparatus comprising:

a pair of rotatable sheet feeding rollers for receiving the single sheets directly from the user and for feeding each of the manually supplied sheets in a given feed direction, said rollers having their axes perpendicular to the feed direction;

sheet detection means arranged at an upstream position with respect to the sheet feeding rollers for detecting the presence of each of the sheets to produce a sheet detection signal upon the manual supply of each sheet;

means for delaying each sheet detection signal supplied from said sheet detecting means by a given constant time period sufficiently long for enabling an operator to manually set each detected sheet at a desired orientation of the edges of the sheet relative to said given feed direction, the orientation of each supplied sheet being independently variable relative to other supplied sheets and determined and set solely by the operator; and driving means responsive to each said delayed sheet detection signal for initiating the rotation of said sheet feeding rollers to feed each supplied sheet in the same orientation relative to the given feed direction as manually set by the operator and after the passage of the given constant time period.

2. An apparatus according to claim 1, wherein said sheet is a sheet like document to be duplicated by an electrophotographic apparatus comprising optically scanning means which scan the sheet like document, while it is fed by said sheet feeding means.

* * * * *